United States Patent [19]

Travis

[11] Patent Number: 4,673,131

[45] Date of Patent: Jun. 16, 1987

[54] MINE DUSTING MACHINE

[76] Inventor: Tonny D. Travis, 120 River Rd., Weber City, Va. 24251

[21] Appl. No.: 703,112

[22] Filed: Feb. 19, 1985

[51] Int. Cl.[4] ..... E01C 19/20

[52] U.S. Cl. ..... 239/673; 239/661; 239/675; 239/676; 239/682; 239/687; 239/689; 298/1 C; 414/517

[58] Field of Search ..... 239/671, 672, 673, 680, 239/664, 682, 687, 661, 681, 689, 676, 675; 118/305, 312, 313, 315; 222/252, 254, 272, 273, 330, 331, 334; 280/490 R; 298/1 C; 414/495, 497, 517

[56] References Cited

U.S. PATENT DOCUMENTS

| | | | |
|---|---|---|---|
| 3,189,355 | 6/1965 | Swenson et al. | 239/675 X |
| 3,559,893 | 2/1971 | Gruben | 239/664 |
| 3,819,120 | 6/1974 | Walker | 239/661 |
| 3,871,588 | 3/1975 | Long et al. | 239/673 |
| 4,090,627 | 5/1978 | Teti | 414/517 |
| 4,140,214 | 2/1979 | Pellhammer | 222/272 X |
| 4,442,979 | 4/1984 | Kupper | 239/673 X |
| 4,510,883 | 4/1985 | Estes | 239/672 X |

FOREIGN PATENT DOCUMENTS

| | | | |
|---|---|---|---|
| 1073015 | 2/1956 | Fed. Rep. of Germany | 239/672 |
| 1299156 | 7/1969 | Fed. Rep. of Germany | 239/681 |

*Primary Examiner*—Andres Kashnikow

[57] ABSTRACT

A mine dusting machine comprising a specialized hopper or scoop bucket having a floor, sides and ends and adapted for carrying substantially free-flowing particulate material, a powered ram on the hopper for pushing the material therein toward the front end thereof, a powered conveyor mounted within the hopper adjacent the front end for transporting the material toward opposite sides of the hopper, separate flingers mounted on the front end at least adjacent each of the sides and adapted to receive the material transported thereto by the conveyor, each of the flingers means having at least one rotatable blade for dispersing the material with considerable force in a generally arcuate pattern.

30 Claims, 11 Drawing Figures

Fig. 1
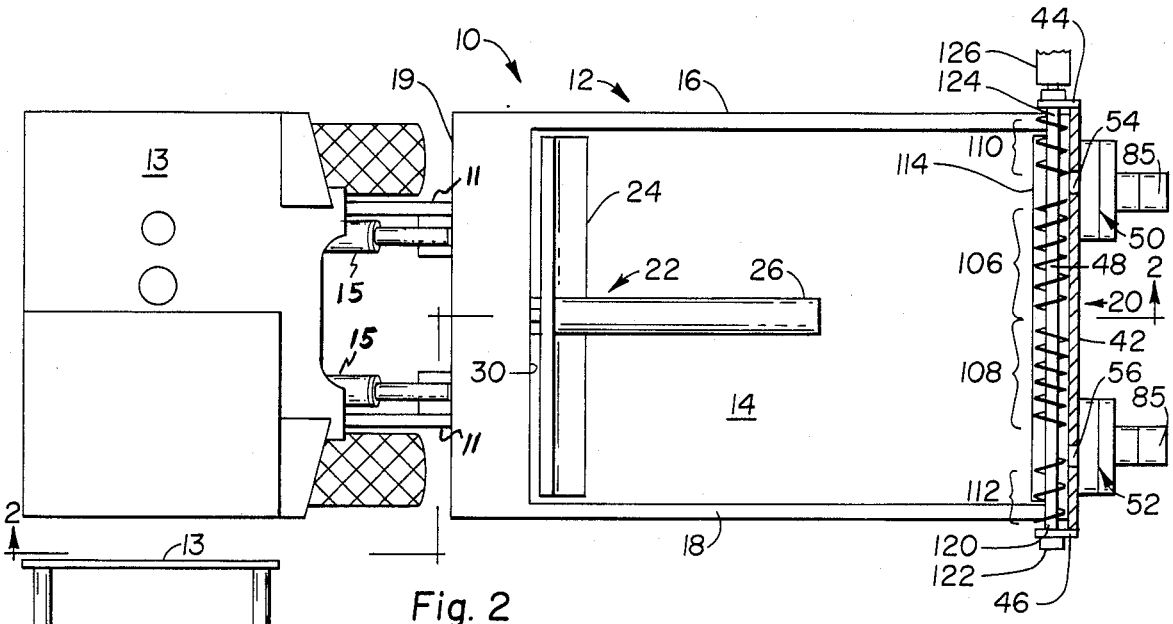
Fig. 2
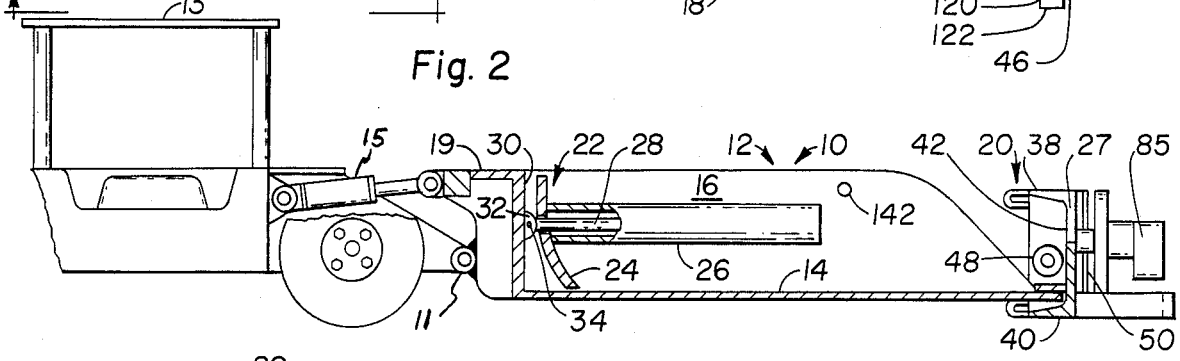
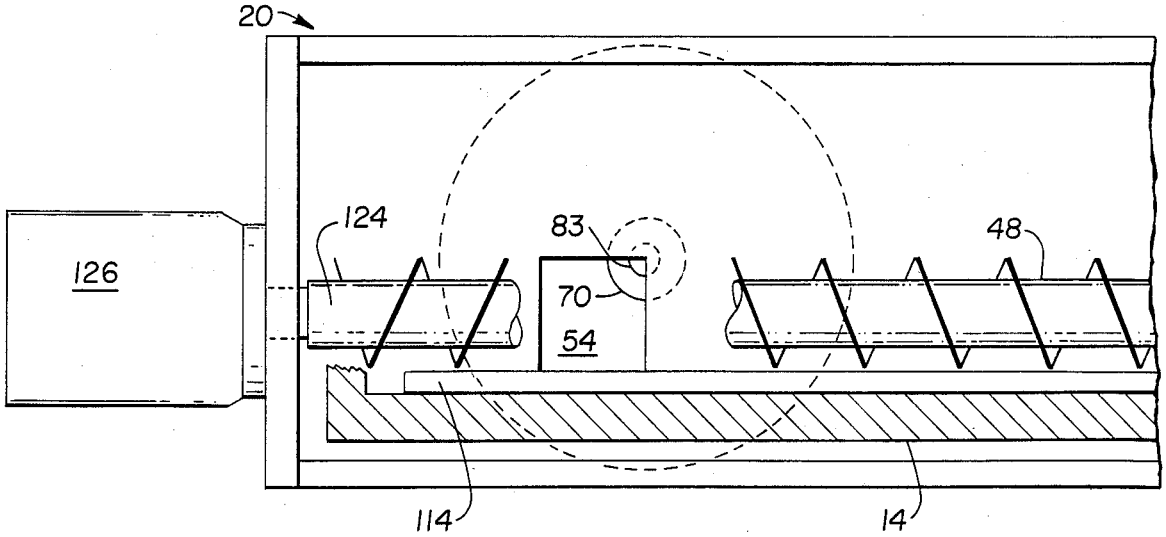
Fig. 3

Fig. 4
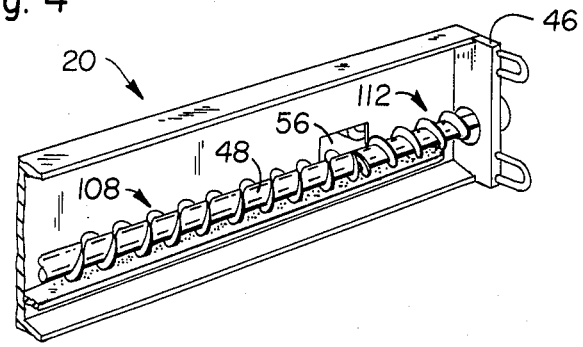
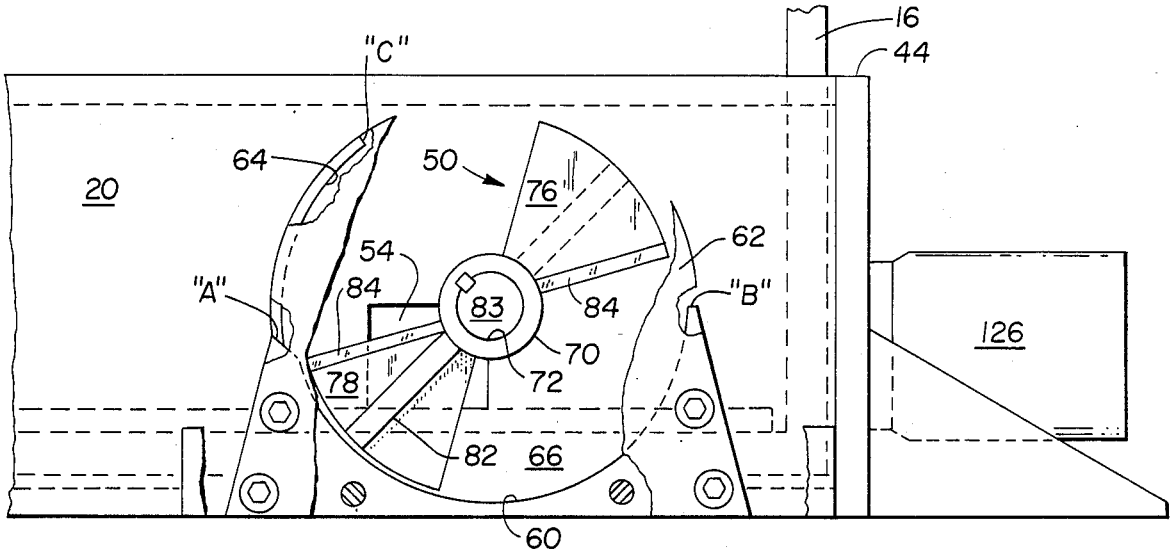
Fig. 5
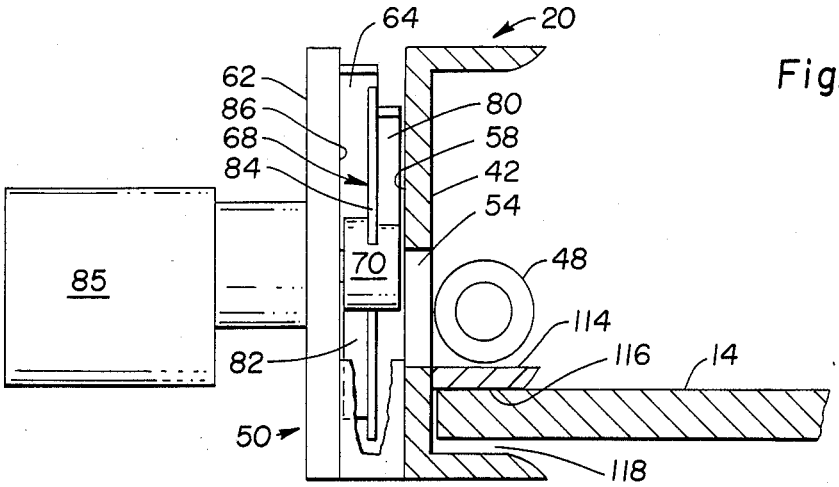
Fig. 6

Fig. 7
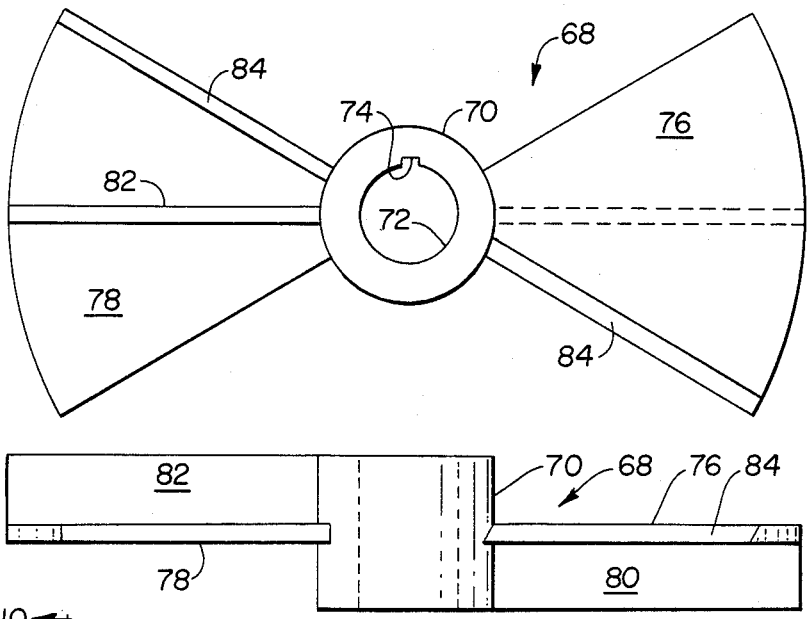
Fig. 10
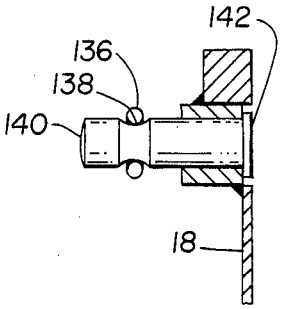
Fig. 8
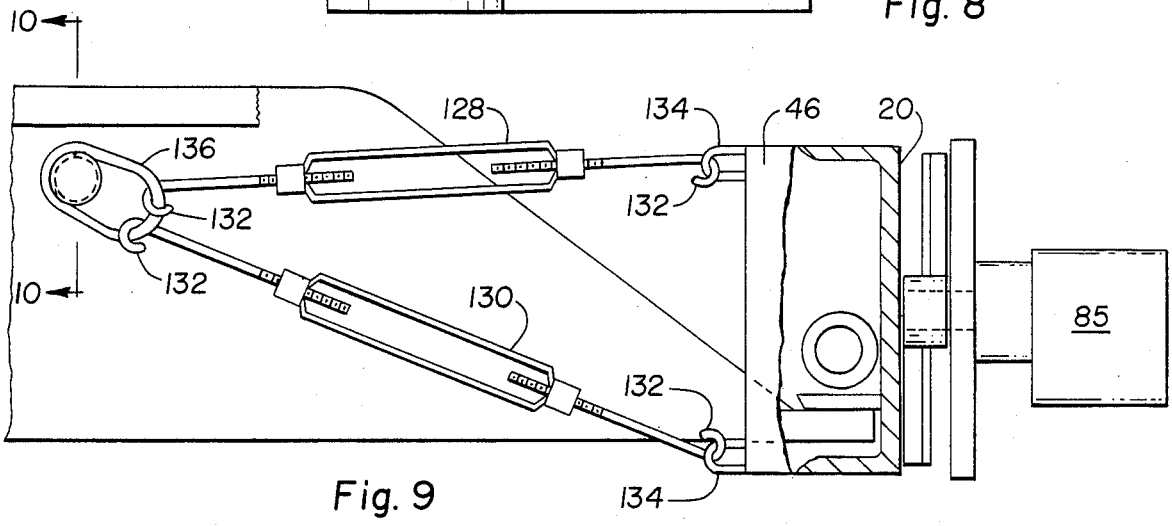
Fig. 9
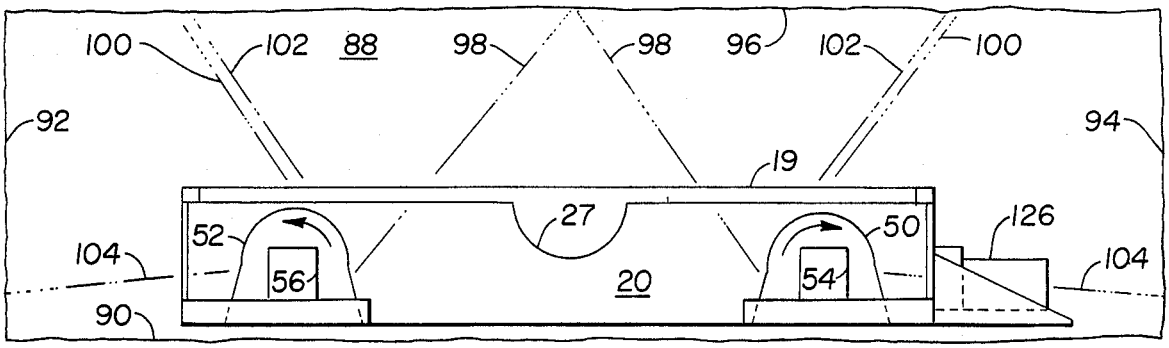
Fig. 11

MINE DUSTING MACHINE

This invention concerns dusting machines which are designed for dispersing large quantities of particulate material into the atmosphere, and particularly concerns such machines which disperse rock dust in coal mines to put down a layer of dust on the mine floor, ribs and roofs to settle coal dust and to minimize the dangers of explosion, for example, from methane.

Dusting machines heretofore developed for such purpose generally comprise a hopper for the rock dust, an auger or the like for moving the dust toward the front of the hopper, and rotating flinger means for receiving the dust and throwing it into the air. Problems which are associated with these machines include, for example, low hopper capacity, low volume output from flingers, complex mechanical construction, inconvenience in use and high cost of construction and maintenance, excessive manpower requirements, and uneven coverage.

Objects of the present invention therefore are: to greatly increase the dusting capability of rock dusting machines; to simplify the construction thereof and thereby reduce cost and maintenance; to simplify the use of such machines through the aforesaid unique construction, thereby reducing the manpower required; and to provide a rock dusting machine which can perform the dusting operation in a fraction of the time heretofore needed, and to provide a rock dusting machine which can evenly cover the mine entry, thus making it easier to maintain scheduled operations.

These and other objects hereinafter appearing have been attained in accordance with the present invention through the discovery of unique rock duster construction, which in its broad sense comprises a specialized hopper or scoop bucket having a floor, sides and ends and adapted for carrying substantially free-flowing particulate material, powered ram means on said hopper for pushing said material therein toward one end thereof, powered conveyor means mounted within said hopper adjacent said one end for transporting said material toward opposite sides of said hopper, separate flinger means mounted on said one end at least adjacent each said side and adapted to receive said material transported thereto by said conveyor means, each said flinger means having rotatable blade means for dispersing said material with considerable force in a generally arcuate pattern.

In a specific embodiment of the present invention, each flinger means is of a unique construction which provides two blades, one of which operates in conjunction with shield means to delay its dispersing action for a prescribed period to thereby provide a greatly increased total dispersing angle.

The invention will be understood further from the following description and drawings wherein:

FIG. 1 is a top view of the present specialized hopper including a portion of the front of a mine utility tractor supporting the hopper;

FIG. 2 is an overall side view, substantially in section of the hopper of FIG. 1;

FIG. 3 is an enlarged view of the helical auger means and its mounting adjacent to the inside of the flinger beam (front end) of the hopper;

FIG. 4 is an isometric view of a portion of the inside of the flinger beam with portions broken away for clarity;

FIG. 5 is a partially sectional view of the front of the flinger beam showing the relative positions of the flingers, their housings and their feed ports;

FIG. 6 is a side view, partially in section, of the flinger beam showing the flinger in detail;

FIG. 7 is a front elevational view of a preferred flinger blade;

FIG. 8 is an edge or side view of the blade of FIG. 7;

FIG. 9 is a partially sectional side view of the hopper showing an embodiment of the means for detachably attaching the flinger beam to the floor and sides;

FIG. 10 is a partially sectional view of a unique attaching pin for holding the flinger beam in place; and FIG. 11 is a schematic view of the inside of the flinger beam as viewed looking into a typical coal mine with the approximate dust dispersing pattern shown by dotted lines.

Referring to the drawings, FIG. 1 shows a partially schematic top view of the present dusting machine (generally termed "scoop" in the mining trade) generally designated 10 comprising a hopper or scoop bucket generally designated 12 and a mine utility tractor 13 attached thereto. The hopper is attached to the front end of the tractor 13 by pivot means 11 which allows pivoting of the hopper in a vertical direction, and wherein power means 15 is connected to the tractor and hopper for rotating the hopper about the pivot means to adjust the elevation thereof. A general type of "scoop" to which the present invention is related is manufactured, for example, by the S & S Equipment Co., Richlands, Va, Model 482. The present hopper comprises floor 14, port side 16, starboard side 18, rear end 19 and the entirely novel front end or flinger beam 20. A powered ram means generally designated 22 is positioned in the hopper for moving (feeding) the rock dust toward the flinger beam and comprises in the embodiment shown, a pusher 24 resembling the form of a bulldozer blade having affixed to the front thereof a hydraulic cylinder 26 having its piston 28 passing through the pusher and affixed to the inner wall 30 of rear end 19 by means of a clevis 32 and pin 34, or by any other convenient means including threading the end of shaft on piston 28 directly into wall 30 or by welding the shaft thereto. The cylinder 26 is preferably sufficiently long to allow pusher 24 to move substantially the full length of hopper 12.

It is not necessary to provide special roller or skid means on the bottom edge and/or ends of pusher 24 to allow a smoother motion thereof, however, such expedient is desirable, especially for large hoppers and pushers. The particular powered ram means shown may, of course, be varied greatly and could comprise, for example, hydraulic, electrical or air operated screw drives or winch drives positioned on the inside or outside of the hopper at each end of the pusher by mechanisms well known to the art. A non-preferred, but operable means to feed the dust to the hopper front could comprise lengthwise oriented auger means, but such a feeding mechanism would be much less efficient and convenient than the pusher shown. I have found, however, that the powered ram construction shown is a most efficient mechanism.

Referring to FIGS. 1–8, the novel flinger or dust dispersing mechanism of the present invention comprises the flinger beam 20 which carries essential components of the present invention and is constructed, in the embodiment shown, to allow rapid and easy assembly, defined in detail below, to the forward portions of a scoop bucket or hopper such as is used in coal mines for various utility purposes. This beam, conveniently shown in the present embodiment as a modified steel channel beam or bar, comprises sides 38 and 40, web 42, end pieces or auger bearings 44 and 46, auger 48, flingers 50 and 52 (any convenient number of such flingers may be used, however), and dust feed ports 54 and 56 opening through web 42.

For ease of understanding of the present invention, and prior to giving further details thereof, suffice it to say at this point that pusher 24, through the actuation of dual actuated cylinder 26, pushes the rock dust onto auger 48 which transmits it into and through ports 54 and 56 to flingers 50 and 52 respectively which throw it upwardly and outwardly in a predetermined pattern to "dust" the ceiling, ribs (walls) and floor of the mine entry. As the pusher approaches its forward limit, cylinder 26 passes through cut-out 27 in beam 20.

As aforesaid, ports 54 and 56 communicate with the flingers, each of which has a housing shown in the present embodiment as consisting of a front surface portion 58 of web 42, an interior arcuate wall 60, a front cover 62, and a dust shield 64, all of which provide a dust pick-up basin or reservoir generally designated 66. Mounted within each basin 66 is blade means generally designated 68, which, as shown in the particular embodiment of the drawings, comprises a hub 70 having a shaft bore 72 and keyway 74 and plate means affixed to said hub and comprising angularly opposed segments 76 and 78 carrying blades 80 and 82 respectively, welded, formed, or otherwise affixed to the segments. Shaft means 83 connects the blade means to a motor 85 which is geared to rotate the blade means clockwise in FIG. 5 at about 1,000 to 3,000 rpm, preferably at about 1,500 to about 2,500 rpm. For purposes of this description with particular reference to FIGS. 5 and 6, the forward or leading blade is designated 82, and is mounted in flinger 50 on the port side of the hopper, and the entire blade means rotates clockwise when viewed from the front of the hopper shown in FIG. 5. Blades 80 and 82, segments 76 and 78, and hub 70 are spaced slightly from the adjacent portions of the housing to allow rotation thereof while providing a large dispersal force to the rock dust. In order to function in the most efficient manner, the leading edges of the blades are bevelled to provide positive dust driving surfaces 84 which impart a forward motion to the dust within the reservoir 66 to provide a constant supply for dispersal by the leading blade 82.

In one of the most preferred embodiments of the present invention, dust shield 64 is provided, preferably welded or the like to the inner surface 86 of front cover 62, to block egress of the dust thrown outwardly by blade 82 for a desired lead segment of its outlet arc. This outlet arc, as viewed in FIG. 5 extends from point "A" to point "B" and the blocked lead segment subtends an angle measured from the horizontal of from "A" to "C", preferably of from about 25° to about 60°. As seen from FIG. 11, an overlapping dust dispersal pattern may be achieved for mine entries of varying size. In this figure, a mine is shown in cross section generally designated 88 and comprises floor 90, ribs 92 and 94 and ceiling 96. The flinger beam 20 is shown in front view and slightly elevated from the mine floor in normal operating position wherein the hopper may be moved progressively along the mine by tractor 13 during the dusting operation. Dotted lines 98 represent the inner pattern limit for dust dispersal by each of flingers 50 and 52 and is determined primarily by the height of point "A" of wall 60 of each flinger with respect to the axis of rotation of blade means 68. This inner pattern, point "A" and said axis are selected according to the particular distance prescribed between the flingers, the height of the shaft ceiling and the desired overlap, if any, of the inner pattern limit at the ceiling. It was found that an outer pattern limit was rapidly reached at about the position of dotted lines 100, long before the mine ribs were properly dusted. To overcome this problem, the unique blade means 68 and dust shield 64 shown in the drawings were devised whereby the dust output of the leading blade 82 of each flinger was blocked for a selected arc to give the inner pattern limits represented by dotted lines 102, which, in the embodiment shown, overlaps with the outer pattern limits 100 to insure full ceiling coverage. The outer pattern limits of blade 82 therefore, due to the delayed dust egress, become dotted lines 104 which reaches essentially the bottom of the mine ribs. These outer pattern limits are determined primarily by the height of point "B" relative to the said axis of rotation of blade means 68. It is apparent therefore, that depending on the width and height of the mine cross section, and the distance between the flingers, the dust dispersal pattern would have to be altered in order to provide full surface coverage. To this end, the height "C" of dust shield 64 and the height of "B" of surface 60 may be made readily adjustable by means known in the mechanical arts.

Referring to FIGS. 1 and 3, the novel auger 48 of the present invention comprises two primary sections of opposed helices 106 and 108 shown bracketed in FIG. 1, and adjacent reverse helical sections 110 and 112, also bracketed in FIG. 1. Underlying auger 48 is a ledge 114 which conveniently serves the dual function of retaining the rock dust in contact with the auger and also providing an upper wall 116 to form slot 118 (see FIG. 6) in cooperation with beam 20. This slot assists in retaining beam 20 on the hopper as described below in further detail. One end 120 of auger 48 is mounted in sealed bearing means 122 in known manner, and the other end 124 is connected to a motor 126 for rotation thereby in a clockwise direction as viewed in FIGS. 4 and 6. It can readily be seen that as rock dust is pushed into contact with auger 48 it will be conveyed by both the primary sections 106 and 108 and their adjacent reverse sections 110 and 112, into the flinger feed ports 54 and 56 respectively. The auger drive motor 126 is preferably geared to rotate the auger at from about 500 to about 1,500 rpm, and most preferably at about 800 to about 1,200 rpm, but lower or higher rpm may be used, depending, for example, on the quantity and dispersal rate desired and the size of the auger and flinger blade means. It has been found that reverse sections 110 and 112 assist greatly in providing adequate feed to the flingers and in preventing dust build-up at the hopper sides with attendant excessive pressure on the pusher 24. All of the motors 85 and 126 are preferably hydraulic, geared type, such as 3000 series PERMCO motors. Electrical, air or other motors may, of course, also be used.

Referring to FIGS. 9 and 10, one type of disconnect means for releasably attaching the flinger beam to the hopper is shown to comprise a pair of turnbuckles 128 and 130 at each end of beam 20 and having hooks 132 at each end for connecting into loops 134 welded to beam ends 44 and 46 on either side of the plane of the hopper floor, and to ring 136. This ring is mounted in groove 138 in pin 140 which is removably mounted in each of the hopper sides as shown in FIG. 10 with its inside end 142 flush with or recessed below the inner surface of the hopper side. In place of this form of disconnect means, various other tensioning mechanisms may be employed such as rachet and pawl, or the load binders (overcentering lever types) shown, for example, on page 339 of the McMaster-Carr Catalog No. 87, 1981.

Many variations of structure may, of course, be employed in the present invention as can be envisioned by one skilled in the art. For example, the plate means of blade means 68 may be a single circular disc having a single or multiple blades thereon; however, the present blade means offers the enormous improvement in dispersibility. Also, more than two flingers may be used, as well as multiple principal helical sections on the auger; or multiple augers could be employed should greater output be desired.

The invention has been described in detail with particular reference to preferred embodiments thereof, but it will be understood that variations and modifications can be effected within the spirit and scope of the invention.

I claim:

1. A dusting machine comprising a specialized hopper or scoop bucket having a floor, generally opposite sides and generally opposite front and rear ends and adapted for carrying substantially free-flowing particulate material, the planes of said sides being substantially parallel to maximize the capacity of said hopper, powered ram means on said hopper for pushing said material therein toward said front end thereof, said ram means extending substantially the full width of said hopper, powered conveyor means mounted within said hopper adjacent said front end and substantially parallel thereto for transporting said material toward each of said opposite sides of said hopper, separate multiple flinger means mounted on said front end, at least one said flinger means being provided adjacent each of said opposite sides and adapted to receive said material transported thereto by said conveyor means, each said flinger means having rotatable blade means for dispersing said material with considerable force in a generally arcuate pattern.

2. The machine of claim 1 wherein said conveyor means comprises helical auger means.

3. The machine of claim 2 wherein said auger means comprises a single auger shaft having its ends rotatably mounted on said opposite sides of said hopper adjacent said end thereof, and wherein said auger means has two primary sections of opposed helices.

4. The machine of claim 3 wherein each said primary section of helices terminates a short distance from its adjacent hopper side, and a reverse section of helices extends from adjacent each said hopper side to the terminal end of its adjacent primary section.

5. The machine of claim 4 wherein a flinger means is positioned adjacent each of said terminal ends of said primary sections.

6. The machine of claim 5 wherein each of said flinger means is mounted on the exterior of said front end of said hopper and communicates with the interior thereof through port means in said front end.

7. The machine of claim 6 wherein power for said conveyor means is provided by hydraulic motor means.

8. The machine of claim 5 wherein the blade means of the flingers rotate in opposite directions to give at least about a 180° dispersal angle.

9. The machine of claim 8 wherein the starboard one of said blade means rotates clockwise and the port one of said blade means rotates counterclockwise.

10. The machine of claim 6 wherein said ram means comprises a pusher positioned within said hopper and extending substantially across the width thereof, and actuator means connected to said pusher for moving said pusher from adjacent said rear end of said hopper toward said front end thereof.

11. The machine of claim 10 wherein said actuator means comprises a hydraulic cylinder attached to the front of said pusher and extending forwardly thereof, and a piston in said cylinder extending rearwardly through said pusher and abutting the rear wall of said hopper.

12. The machine of claim 1 wherein each said flinger means comprises a housing, dust outlet means in the upper portion of said housing, blade means connected to shaft means rotatably mounted in said housing, dust inlet means in said housing communicating with said hopper, and power means connected to said shaft means for rotating said shaft means and said blade means.

13. The machine of claim 12 wherein said blade means comprises two blades angularly offset approximately 180° on said shaft means.

14. The machine of claim 13 wherein said housing is provided with shield means for blocking a lead segment of the outlet arc for one of said blades.

15. The machine of claim 14 wherein said outlet arc is at least about 180° and said lead segment is from about 25° to about 60°.

16. The machine of claim 15 wherein said blades are mounted on opposite sides of plate means, the plane of which is substantially normal to the axis of said shaft means, said plate means comprising two substantially angularly opposed segments attached to said shaft means.

17. The machine of claim 16 wherein the leading edge of at least one of said segments of said plate means is bevelled forwardly to provide a dust feed to the forwardly facing blade.

18. The machine of claim 16 wherein the outer edge of each of said opposed segments subtends an angle about the axis of said shaft means of from about 10° to about 80°.

19. The machine of claim 12 wherein said blade means are mounted on plate means, the plane of which is substantially normal to the axis of said shaft means.

20. The machine of claim 1 wherein said hopper is attached to the front end of a mine utility tractor by pivot means which allows pivoting of said hopper in a vertical direction, and wherein power means is connected to said tractor and said hopper for rotating said hopper about said pivot means to adjust the elevation thereof.

21. The machine of claim 1 wherein said front end of said hopper is detachable from the rest of said hopper in that the rewardly facing surface of said front end is provided with transverse slot means, and said hopper floor is provided with a forward edge, said slot means being adapted to receive said forward edge of said hopper floor in nesting arrangement.

22. The machine of claim 21 wherein cooperating disconnect means are provided on each end of said front end and on each of the sides of said hopper to hold said front end in place in said nesting arrangement.

23. The machine of claim 22 wherein said disconnect means comprises at least one tensioner and cooperating connectors on each end of said front end and on each side of said hopper.

24. The machine of claim 23 wherein the cooperating connectors comprise at least one loop on each end of said front end and a pin and ring on each of said hopper sides, and wherein the ends of each said tensioner are hook shaped to releasably connect to said loop and ring.

25. The machine of claim 24 wherein said tensioner is selected from a turnbuckle device, an overcentering lever device, and a ratchet and pawl device.

26. The machine of claim 25 wherein said disconnect means comprises a pair of tensioners and cooperating connectors on each end of said front end and on each side of said hopper, wherein the points of attachment of the tensioners of each of said pairs to said each end of said front end are on opposite sides of the plane of said floor.

27. Flinger means for use on rock dusting machines comprising a housing, dust outlet means in the upper portion of said housing subtending an outlet arc of at least about 180 degrees having a lead segment of from about 25 degrees to about 55 degrees, blade means connected to shaft means rotatably mounted in said housing, dust inlet means in said housing adapted to communicate with a dust hopper, power means connected to said shaft means for rotating said shaft means and said blade means, said blade means comprising two blades angularly offset approximately 180 degrees and axially adjacent on said shaft means, said blades being mounted on opposite sides of plate means the plane of which is substantially normal to the axis of said shaft means, said plate means comprising two substantially angularly opposed segments attached to said shaft means, and said housing being provided with shield means for blocking said lead segment of said outlet arc for one of said blades.

28. The flinger means of claim 27 wherein the leading edge of at least one of said segments of said plate means is bevelled forwardly to provide a dust feed to the forwardly facing blade.

29. The flinger means of claim 28 wherein the outer edge of each of said opposed segments subtends an angle about the axis of said shaft means of from about 10° to about 80°.

30. The flinger means of claim 29 wherein the planes of said opposed segments coincide.

* * * * *